US009665117B2

(12) United States Patent
Benzerrock

(10) Patent No.: US 9,665,117 B2
(45) Date of Patent: May 30, 2017

(54) METHOD TO IMPROVE THE RESOLUTION OF AN SCR BASED POWER SUPPLY

(71) Applicant: Warner Power Company LLC, Warner, NH (US)

(72) Inventor: Souheil Benzerrock, Windham, NH (US)

(73) Assignee: Warner Power Acquisition, LLC, Warner, NH (US)

( * ) Notice: Subject to any disclaimer, the term of this patent is extended or adjusted under 35 U.S.C. 154(b) by 0 days.

(21) Appl. No.: 14/919,021

(22) Filed: Oct. 21, 2015

(65) Prior Publication Data

US 2016/0103465 A1 Apr. 14, 2016

Related U.S. Application Data

(60) Provisional application No. 62/066,512, filed on Oct. 21, 2014.

(51) Int. Cl.
*G05F 5/00* (2006.01)

(52) U.S. Cl.
CPC ..... *G05F 5/00* (2013.01)

(58) Field of Classification Search
CPC ..... G05F 5/00; H05B 1/0202; H05B 3/03
See application file for complete search history.

(56) References Cited

U.S. PATENT DOCUMENTS 4,370,703 A * 1/1983 Risberg ..... H02M 3/142 219/668
2005/0146308 A1* 7/2005 Quazi ..... H02P 9/48 322/28
2011/0157942 A1* 6/2011 Babcock ..... H02M 1/425 363/126
2012/0299500 A1* 11/2012 Sadwick ..... H05B 33/0887 315/224
2013/0066307 A1* 3/2013 Ko ..... H05B 41/30 606/9

* cited by examiner

*Primary Examiner* — Jue Zhang

(57) ABSTRACT

A method to provide high resolution power control in SCR based power supplies utilizing dithering designed to introduce perturbations in the control signal to the power supply controller or firing circuit+, and to thereby control the output of the power supply with increased resolution.

4 Claims, 4 Drawing Sheets

METHOD TO IMPROVE THE RESOLUTION OF AN SCR BASED POWER SUPPLY

CROSS-REFERENCE TO RELATED APPLICATIONS

This application claims the benefit of U.S. Provisional Application Ser. No. 62/066,512 for the invention entitled, "Method and Apparatus to Improve the Resolution of an SCR Based Power Supply" filed Oct. 21, 2014 incorporated fully herein by reference.

TECHNICAL FIELD

The present invention relates to power supplies and more particularly, relates to a method to provide high resolution power control in SCR based power supplies utilizing a signal and image processing technique called "dithering" designed to introduce perturbations in the control signal to the power supply controller or firing circuit (and hence to control the output of the power supply).

BACKGROUND INFORMATION

Silicon-Controlled Rectifiers (SCRs) are a type of thyristor that can carry and control large currents utilizing a low voltage/current control signal. SCR's are used to control AC current for lighting or motor drive, for circuit protection as "crowbars" or as rectifiers in DC power supplies. They have been referred to as the workhorse for high power applications where high current or voltage is switched and controlled, especially in industrial applications. In industrial heating, for example, many furnaces utilize an SCR based controller to control the power delivered to the heating element or the electrodes.

SCRs are typically controlled with two methods; zero-cross, and phase angle. In the zero-cross control method, the SCR is triggered after the voltage has crossed zero and due to its construction, the SCR will be on for the subsequent half cycle. This technique is useful in applications with an emphasis on electromagnetic emissions. This technique is limited in resolution since the SCR will always be conducting for at least half cycle every time a gate trigger signal is available.

For higher resolution applications, the second method is more in use where the SCR is triggered at a specific firing angle after zero-cross. This technique gives the ability to trigger at any time in the cycle when the SCR is forward biased. This technique has the advantage of providing for the highest resolution. However, in practice it is limited by the resolution of the controller and the firing circuitry which includes a timer for the firing of pulse trains. Furthermore, new heating and power applications require higher power outputs and extremely broad control ranges with higher resolutions. Additionally most control systems are moving towards digital control systems, which adds a degree of complexity and additional sources of errors and inaccuracies.

A typical SCR based DC or AC power supply will have the SCRs placed either in the primary side of a transformer or secondary. A block diagram of a common prior art DC power supply is shown in FIG. 1.

In this Figure, a user interface 12, which can be remote where the end user enters or programs the desired power, voltage or current output then communicate it to the system controller 14 via either an analog or a digital link 16. The interface 12 can also be local to the power supply though an HMI, a keypad or a dial. The desired output (the setpoint) is communicated to the control system 14 which can be supervised by either a microcontroller, a Digital signal Processor (DSP), a Field Programmable Gate Array (FPGA), an analog controller or a Programmable Logic Controller (PLC).

The control system 14 outputs either an analog signal or a digital signal 18 that represents the firing angle. This signal 18 is transmitted to the firing circuitry 20 where the signal 18 is interpreted and a gate firing signal 22 is generated to allow current to flow through the SCRs 24 to the load 26 for the specified amount of time.

Typically the output of an Analog-to-digital converter (ADC) is converted into a signal equivalent to a firing angle from 0 to 180°. For example, a 10 bit ADC has a full range of 1024 counts which means a resolution [R] of $$R = \frac{180}{1024} = 0.175^{\circ}/\text{count}.$$

To put this number in perspective, one can analyze the relationship between phase angle and voltage which is written as follows:

$$V_{oRMS} = \sqrt{3}\,V_s\sqrt{\left(\frac{1}{2} + \frac{3\sqrt{3}}{4\pi}\cos 2\alpha\right)} \tag{1}$$

Here $V_{oRMS}$ is the output voltage, Vs the source voltage and $\alpha$ is the firing angle. Since most heating applications prefer power control, a more important factor is the power resolution, where the relationship between firing angle and resolution is as follows:

$$P_o = \frac{3V_s^2}{R}\left(\frac{1}{2} + \frac{3\sqrt{3}\,\theta}{4\pi}\cos 2\alpha\right) \tag{2}$$

In theory this equation shows a very high resolution and accuracy, however, in practice a 1% accuracy is very difficult to achieve and a 1° resolution is almost impossible. A 1° resolution is equivalent to 120 W in a 100 kW power system and 300 W in a 500 kW power system.

Accordingly, what is needed is a method and system to provide high resolution power control in SCR based power supplies.

SUMMARY OF THE INVENTION

The invention features a method for controlling an SCR based power supply comprising providing an SCR based power supply including at least a user interface. The user interface is configured for allowing a user to enter one or more of a desired power supply power value, a power supply voltage value or a power supply current value, a controller, an SCR firing circuit and a dither signal generator.

The SCR based power supply then receives, from the user interface, the one of the desired power supply output voltage value, the power supply current output value, or the power supply power output value. The SCR based power supply provides the desired one of a power supply output voltage value, power supply output current value or power supply power output value to a dither generator.

Responsive to the received one of a power supply output voltage value, power supply output current value or power supply power output value, the dither generator is programmed or configured to provide a dither control signal.

In one embodiment, the dither control signal is provided to one of either the SCR power supply controller or the SCR firing circuit.

The method provides dithering setpoints according to the formula $$P_{set} = \frac{\sum_{k=1}^{N} p_{setk}}{N}$$

$$X_{set} = \frac{\sum_{k=1}^{N} X_{setk}}{N};$$

where N is the number of samples;

where k is the index; and where $X_{set}$ equals one of: where $P_{set}$ (the power set point when power control is desired); $V_{set}$ (the voltage set point when voltage control is desired; or $I_{set}$ (the current set point when current control is desired).

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

The present invention features a system and method wherein a dithering technique, and therefore a dithering signal, may be applied at either the control stage, the firing stage or both in a power supply. The invention introduces dithering as a random control sequence which is added either to the external setpoint which is then interpreted by the angle control section of the controller, or to the control signal prior to a conversion into a firing signal or a gate drive signal.

The method of the present invention is based on a well-established signal and image processing technique called "dithering". The basic premise of this technique is to introduce perturbations in the control signal (hence the output signal) with the lowest resolution or at the least significant bit in digital controllers, and average the output. It has been shown in signal processing that a four times improvement in resolution is easily achievable utilizing such a method.

In this invention, the prior art issues are addressed with the dithering technique applied at either the control stage, the firing stage, or both. Dithering is a signal processing technique that helps extend the dynamic range of a signal by first injecting or adding a perturbation then averaging the resulting signal. This technique was first developed to enhance the performance of RADARs and was later expanded and used in other areas of signal processing such as image processing.

Figure 1:
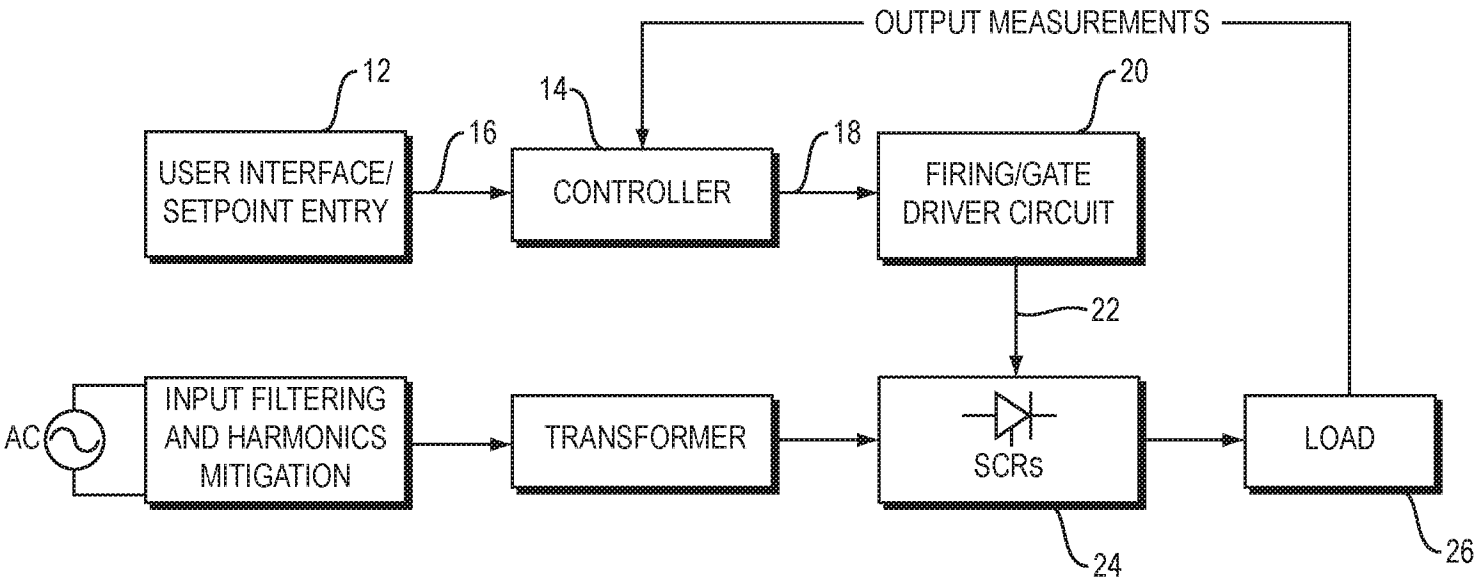
FIG. 1 (PRIOR ART)
FIG. 1 is a schematic diagram of a prior art typical DC power supply with SCR's in the secondary of the transformer.

To quadruple the resolution of such prior art systems as described in connection with FIG. 1, a sequence of four consecutive setpoints is required such that the unfiltered output will be a sequence.

For example, a 100 kW system with a 10 bit conversion resolution will be represented by approximately 100 W per bit, therefore as implemented in prior art systems and methods, it is impossible to output a power with 25 W resolution; for example 50,025 W, 50,050 W, or 50,075 W. Such a system can only output 50000 W or 50100 W. If a dithering sequence of four outputs according to the present invention is introduced and subsequently the output is filtered, it will be capable to deliver the desired values. For a desired value of 50,025 W, the method according to the invention interjects a sequence of four outputs as follows: $P_{set1}$=50,100 W, $P_{set2}$=50,000 W, $P_{set3}$=50,000 W, $P_{set4}$=50,000 W then average the outputs as follow:

$$P_{set} = \frac{P_{set1} + P_{set2} + P_{set3} + P_{set4}}{4} = 50{,}025 \text{ W} \tag{3}$$

To generalize the present approach, for an improvement in resolution by a factor of N, the method according to the invention will introduce a sequence of N setpoints and average with the output as shown below in formula (4):

$$P_{set} = \frac{\sum_{k=1}^{N} P_{setk}}{N} \tag{4}$$

In theory, the number of samples or setpoints introduced can be infinite, however, in practice the dither samples will be limited by the size of the filter and the sampling rate of the system (i.e. limited by the clock/processor speed and the a/d convertor speed).

A typical application for SCR based power supplies controlled according to the method of the present invention include, but are not limited to, crystal growing and industrial heating with thermal time constants of several seconds which will allow the accumulation of 600 samples in 10 seconds which in turn improves the resolution by a factor of 6000. This approach allows single watt resolution in a 500 kW power system to be accomplished.

Introducing dithering where a random control sequence is added either to the external setpoint which is then interpreted by the angle control section of the controller, or to the control signal prior to a conversion into a firing signal or a gate drive signal. Due to the large thermal time constant of the system, perturbing and averaging can be performed for many cycles. A typical improvement in accuracy is the square root of the number of samples accumulated. With the accumulation of 100 samples, an improvement of a factor of ten can be achieved. This will lead into a resolution of accuracy of 6 W for a 100 kW power system and 30 W for the 500 kW system. A typical application include crystal growing and industrial heating with thermal time constants of several seconds which will allow the accumulation of 600 samples in 10 seconds which in turn improves the resolution by a factor of 6000. This approach allows the present method to accomplish single watt resolution in 500 kW power system.

A second and major issue this invention addresses is related to the control capability of the system, especially when employing digital controllers similar to the ones listed above. For a PID system, the control law for phase angle, we can write:

$$\alpha(k+1)=K_p\alpha_e(k)+K_i[\alpha_e(k-1)+\alpha_e(k)]+K_d[\alpha_e(k)-\alpha_e(k-1)]+\alpha_{ref}(k) \quad \text{Equation (5)}$$

Figure 2:
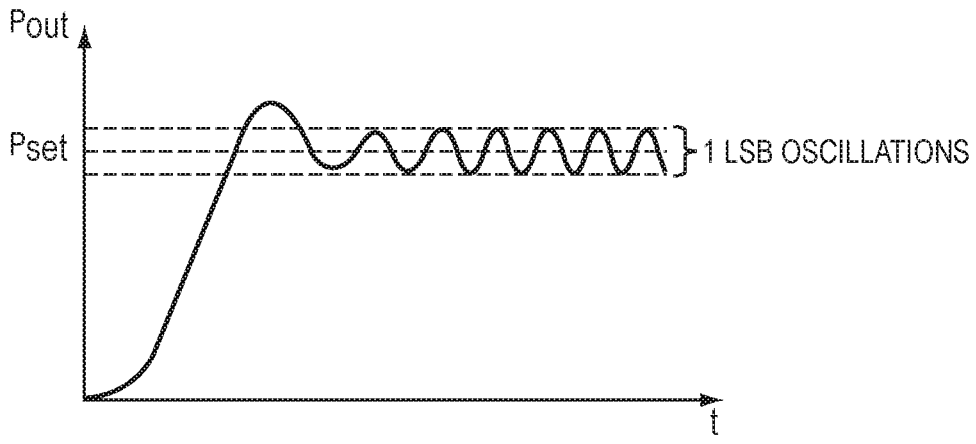
FIG. 2 is a graph illustrating oscillations that can occur in prior art system controllers.

Such that $\alpha(k+1)$ is the next phase angle setpoint (at sequence k+1); $\alpha_e(k)$ is the current phase angle error; and $\alpha_e(k-1)$ is the previous error (at sequence k−1). It is clear that the system in this case is required to be higher resolution than the analog to digital converter. For example, if the PID controller is a 10 bit controller, the system will fall into limit cycling. Limit cycling is an oscillation of the system. As shown in the graph in FIG. 2, the oscillation is to within a single bit (LSB or Least (or lowest) Significant Bit).

Figure 3:
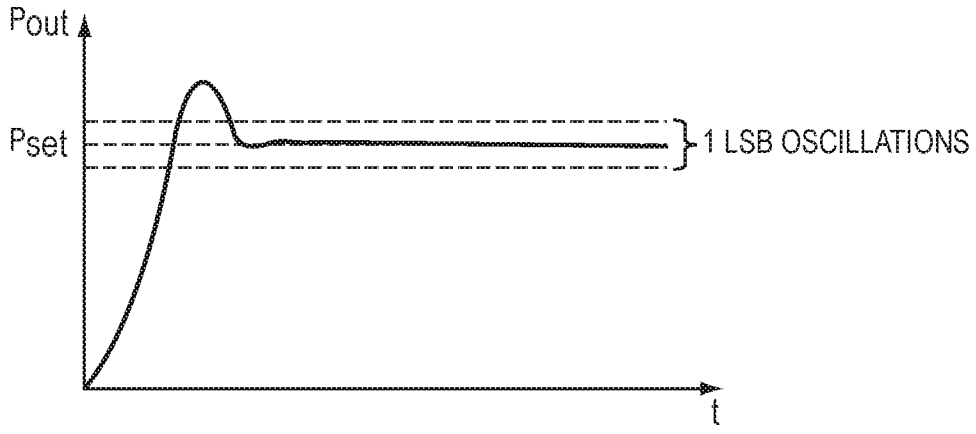
FIG. 3 is a graph illustrating the lack of system oscillation utilizing the dithering method according to the present invention.
Figure 4:
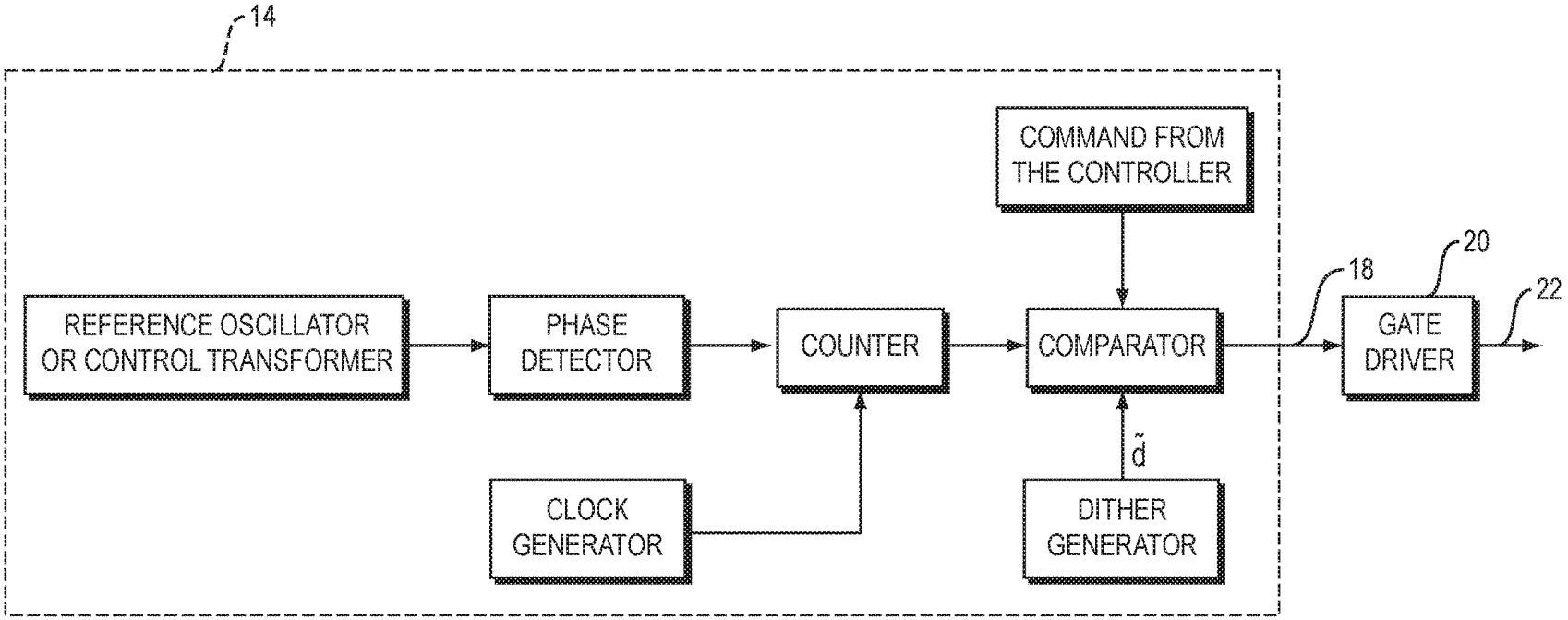
FIG. 4 is a schematic block diagram of an SCR gate firing circuit including a dithering generator according to the method of the present invention.

By introducing dithering, the method of the present invention is able to eliminate this oscillation (See FIG. 3) since the resolution is much greater than the low or least significant bit. FIG. 3 is a system response with dither applied to improve the resolution and eliminate limit cycling or oscillations.

Figure 5:
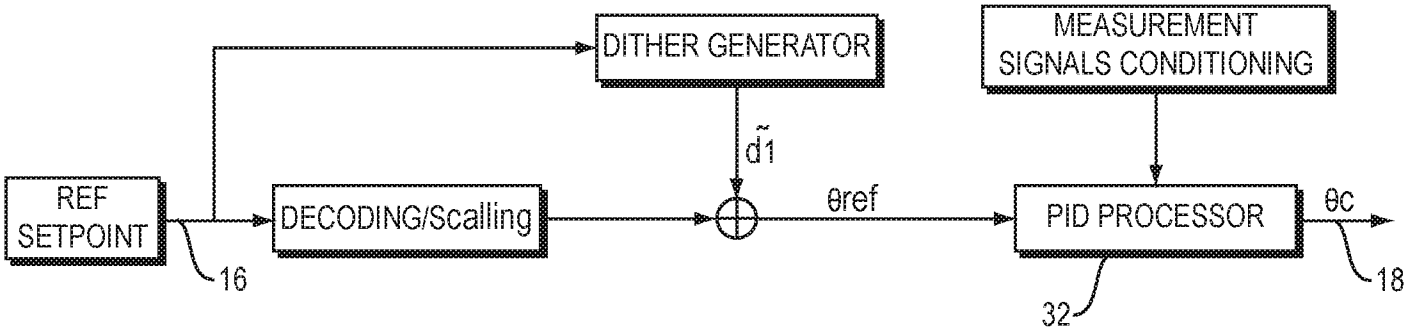
FIG. 5 is a schematic block diagram of a first embodiment of a system implementing the method according to the present invention, wherein dithering is applied to the control stage.

In a first implementation or embodiment of the method of the invention, dithering is applied to the control stage as shown in FIG. 5. The controller 14 consists of an analog to digital converter (ADC or A/D converter) which digitizes the output measurements (typically current, voltage or both); a digital controller in the form of a Digital Signal Processor (DSP), a field programmable gate array (FPGA), a microcontroller, a microprocessor, or in many cases a programmable logic controller PLC. The controller 14 is programmed to output a signal 18 that represents the firing angle.

A dither generator according to one aspect of the invention may be implemented as either a hardware circuit or a software routine, either of which generate a sequence of perturbations as described above in paragraphs 0028 through 0031, for example.

Figure 6:
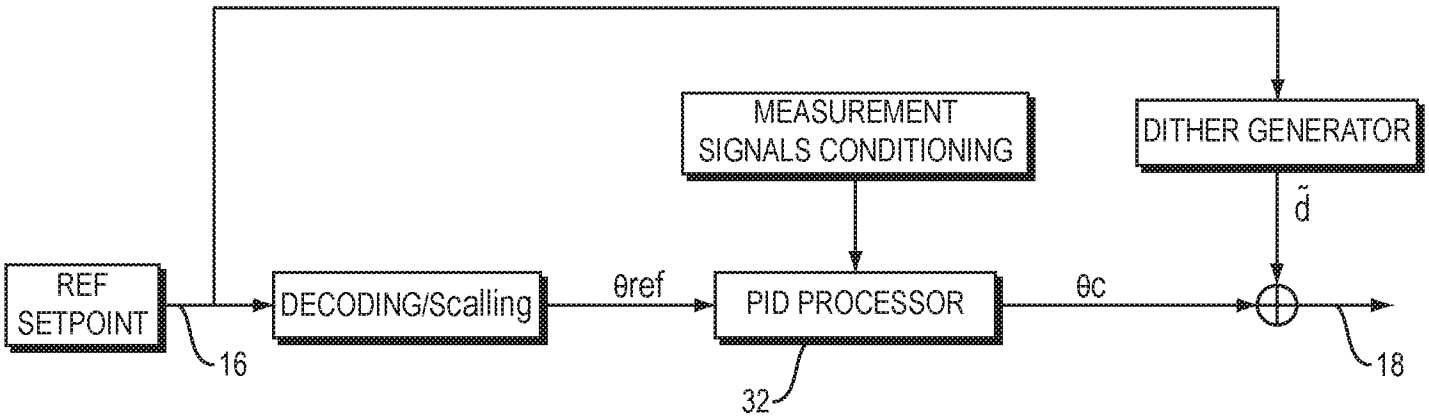
FIG. 6 is a schematic block diagram of a second embodiment of a system implementing the method according to the present invention, wherein dithering is applied to the firing circuit stage.

A second implementation or embodiment of a system implementing the method according to the present invention is shown in FIG. 6. The difference between the embodiment disclosed in FIG. 5 and that disclosed in FIG. 6 is the position where dither is introduced. In the first embodiment shown in FIG. 5, dither is applied right at the user input 12 and is an input to the controller 14. This approach has the benefit of lower noise to the overall system as filtering occurs right before the SCR firing circuit 20. Filtering may be performed by hardware (for example an R/C network) or by software. According both hardware and software filters are contemplated by the invention. Hence the SCR is run in a linear mode. This embodiment however, provides limited resolution improvement due to the limited filtering. The second and preferred embodiment is shown in FIG. 6 wherein dither is applied after the control (after PID controller 32) and right to the input of the SCR. This allows the method to use a larger filter, therefore, improved resolution.

Accordingly, the present invention provides a novel method to provide high resolution power control in an SCR-based powers by introducing dithering prior to the SCR gate firing circuit to improve resolution in the output control signal.

Modifications and substitutions by one of ordinary skill in the art are considered to be within the scope of the present invention, which is not to be limited except by the allowed claims and their legal equivalents.

The invention claimed is:

1. A method for controlling an SCR based power supply, comprising:

providing an SCR based power supply including at least a user interface, said user interface configured for allowing a user to enter one or more of a desired power supply power output value, a power supply output voltage value or a power supply output current value, said SCR based power supply further including a controller, an SCR firing circuit and a dither signal generator;

said SCR based power supply receiving, from the user interface, at least one of said user entered desired power supply output voltage value, said power supply current output value, or said power supply power output value;

providing, by said SCR based power supply said user entered least one of said power supply output voltage value, said power supply output current value or said power supply power output value to a dither generator; and responsive to said received at least one of said power supply output voltage value, said power supply output current value or said power supply power output value, said dither generator configured to provide a dither control signal, wherein said dither control signal is provided utilizing dithering setpoints according to the formula $$X_{set} = \frac{\sum_{k=1}^{N} X_{setk}}{N};$$

where N is the number of samples;

where k is the index; and where $X_{set}$ equals one of: $P_{set}$ (the power set point when power control is desired); $V_{set}$ (the voltage set point when voltage control is desired; or $I_{set}$ (the current set point when current control is desired).

2. The method of claim 1, wherein said dither control signal is provided to one of said SCR power supply controller and said SCR firing circuit.

3. The method of claim 1, wherein said dither control signal is provided as an input to said SCR based power supply controller.

4. The method of claim 1, wherein said dither control signal is provided directly to said firing circuit.

* * * * *